US006852196B2

(12) United States Patent
Capizzi

(10) Patent No.: US 6,852,196 B2
(45) Date of Patent: Feb. 8, 2005

(54) FOAM TREATMENT OF TISSUE PRODUCTS

(75) Inventor: Joseph G. Capizzi, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 101 days.

(21) Appl. No.: 10/007,627

(22) Filed: Nov. 8, 2001

(65) Prior Publication Data

US 2002/0092635 A1 Jul. 18, 2002

Related U.S. Application Data

(60) Provisional application No. 60/246,771, filed on Nov. 8, 2000.

(51) Int. Cl.[7] ..... D21H 11/00

(52) U.S. Cl. ..... 162/101; 162/111; 162/135; 162/158; 162/204; 162/207; 427/243; 427/244; 427/294; 427/420; 118/410; 118/413; 428/318.4

(58) Field of Search ..... 162/112, 111, 162/101, 135, 158, 204, 207, 157; 427/243, 244, 294, 420; 118/410, 413; 428/318.4

(56) References Cited

U.S. PATENT DOCUMENTS

| | | | |
|---|---|---|---|
| 3,722,469 | A | 3/1973 | Bartley et al. |
| 3,865,078 | A | 2/1975 | De Howitt et al. |
| 3,905,329 | A | 9/1975 | Cone et al. |
| 3,930,465 | A | 1/1976 | Schuierer |
| 4,005,028 | A | 1/1977 | Heckert |
| 4,005,030 | A | 1/1977 | Heckert |
| 4,016,831 | A | 4/1977 | James et al. |
| 4,023,526 | A | 5/1977 | Ashmus et al. |
| 4,061,001 | A | 12/1977 | von der Eltz et al. |
| 4,081,318 | A | 3/1978 | Wietsma |
| 4,089,296 | A | 5/1978 | Barchi |
| 4,099,913 | A | 7/1978 | Walter et al. |
| 4,118,526 | A | 10/1978 | Gregorian et al. |

(List continued on next page.)

FOREIGN PATENT DOCUMENTS

| | | | |
|---|---|---|---|
| DE | 252208 | | 10/1911 |
| EP | 0047908 | A1 | 3/1982 |
| EP | 0098362 | B1 | 1/1984 |
| EP | 0120472 | A1 | 10/1984 |
| EP | 0195458 | A1 | 9/1986 |
| EP | 0196576 | | 4/1989 |
| EP | 0336439 | A2 | 10/1989 |
| EP | 1149947 | | 10/2001 |
| GB | 1585874 | | 3/1981 |
| WO | WO9840207 | A1 | 9/1998 |
| WO | WO9913158 | | 3/1999 |
| WO | WO9919081 | | 4/1999 |
| WO | WO0015907 | A1 | 3/2000 |
| WO | WO0216689 | A3 | 2/2002 |
| WO | WO0216689 | A2 | 2/2002 |
| WO | WO0238865 | A2 | 5/2002 |
| WO | WO0238865 | A3 | 6/2002 |

OTHER PUBLICATIONS

PCT Search Report KCX–316–PCT (Feb. 26, 2003).
Recent Developments in Foam Application Systems.
U.S. patent application Ser. No. 10/161,047, Capizzi, filed May 31, 2002.
U.S. patent application Ser. No. 10/161,048, Capizzi, filed May 31, 2002.
U.S. patent application Ser. No. 10/161,049, Capizzi, filed May 31, 2002.

*Primary Examiner*—Steven P. Griffin
*Assistant Examiner*—Mark Halpern
(74) *Attorney, Agent, or Firm*—Dority & Manning, P.A.

(57) ABSTRACT

A method for applying a foam to a paper web is provided. Specifically, a foam is first formed from a liquid-based composition and a gas, such as air. Once formed, the foam is applied by a foam applicator to the web. In one embodiment, for example, the foam applicator applies the foam without substantially contacting the web. Whenapplied with the foam, the web typically has a solids consistency less than about 95% by weight of the web. In some embodiments, one or more vacuum slots can be utilized in conjunction with the foam applicator to facilitate uniform application of the foam to the paper web.

22 Claims, 4 Drawing Sheets

U.S. PATENT DOCUMENTS 4,158,076 A 6/1979 Wallsten
4,159,355 A 6/1979 Kaufman
4,184,914 A 1/1980 Jenkins
4,193,762 A 3/1980 Namboodri
4,198,316 A 4/1980 Nahta
4,230,746 A 10/1980 Nahta
4,237,818 A 12/1980 Clifford et al.
4,263,344 A 4/1981 Radvan et al.
4,276,339 A 6/1981 Stoveken
4,279,964 A 7/1981 Heller
4,288,475 A 9/1981 Meeker
4,297,860 A 11/1981 Pacifici et al.
4,305,169 A 12/1981 Vidalis
4,343,835 A 8/1982 Jones et al.
4,348,251 A 9/1982 Pauls et al.
4,364,784 A 12/1982 Van Wersch et al.
4,366,682 A 1/1983 Keller
4,384,867 A 5/1983 Grüber
4,385,954 A 5/1983 Pauls et al.
4,387,118 A 6/1983 Shelton
4,400,953 A 8/1983 Driessen et al.
4,402,200 A 9/1983 Clifford et al.
4,435,965 A 3/1984 Sasseville et al.
4,440,808 A 4/1984 Mitter
4,442,771 A 4/1984 Mitter
4,444,104 A 4/1984 Mitter
4,453,462 A 6/1984 Mitter
4,463,467 A 8/1984 Grüber et al.
4,463,583 A 8/1984 Krüger et al.
4,474,110 A 10/1984 Rosner
4,497,273 A 2/1985 Mitter
4,498,318 A 2/1985 Mitter
4,501,038 A 2/1985 Otting
4,502,304 A 3/1985 Hopkins
4,534,189 A 8/1985 Clifford
4,552,778 A 11/1985 Zimmer
4,557,218 A 12/1985 Sievers
4,559,243 A 12/1985 Pässler et al.
4,562,097 A 12/1985 Walter et al.
4,571,360 A 2/1986 Brown et al.
4,576,112 A 3/1986 Funger et al.
4,581,254 A 4/1986 Cunningham et al.
4,597,831 A 7/1986 Anderson
4,612,874 A 9/1986 Mitter
4,646,675 A 3/1987 Arthur et al.
4,655,056 A 4/1987 Zeiffer
4,665,723 A 5/1987 Zimmer
4,667,882 A 5/1987 Pacifici
4,731,092 A 3/1988 Berendt
4,734,100 A 3/1988 Berendt et al.
4,741,739 A 5/1988 Berendt et al.
4,762,727 A 8/1988 Voswinckel
4,773,110 A 9/1988 Hopkins
4,778,477 A 10/1988 Lauchenauer
4,792,619 A 12/1988 Berendt et al.
4,799,278 A 1/1989 Beeh
4,833,748 A 5/1989 Zimmer et al.
4,872,325 A 10/1989 Moser et al.
4,894,118 A 1/1990 Edwards et al.
4,912,948 A 4/1990 Brown et al.
5,008,131 A 4/1991 Bakhshi
5,009,932 A 4/1991 Klett et al.
5,048,589 A 9/1991 Cook et al.
5,089,296 A 2/1992 Bafford et al.
5,145,527 A 9/1992 Clifford et al.
5,165,261 A 11/1992 Cho
5,219,620 A 6/1993 Potter et al.
5,227,023 A 7/1993 Pounder et al.
5,328,685 A 7/1994 Janchiraponvej et al.
5,340,609 A 8/1994 Arthur et al.
5,366,161 A 11/1994 Potter et al.
5,399,412 A 3/1995 Sudall et al.
5,492,655 A 2/1996 Morton et al.
5,505,997 A 4/1996 Strong et al.
5,510,001 A 4/1996 Hermans et al.
5,524,828 A 6/1996 Raterman et al.
5,552,020 A 9/1996 Smith et al.
5,591,309 A 1/1997 Rugowski et al.
5,605,719 A 2/1997 Tench et al.
5,635,469 A 6/1997 Fowler et al.
5,667,636 A 9/1997 Engel et al.
5,792,737 A 8/1998 Grüning et al.
5,795,386 A 8/1998 Foster et al.
5,830,483 A 11/1998 Seidel et al.
5,840,403 A 11/1998 Trokhan et al.
5,857,627 A 1/1999 Horwell et al.
5,861,143 A 1/1999 Peterson et al.
5,869,075 A 2/1999 Krzysik
5,904,809 A 5/1999 Rokman et al.
5,985,434 A 11/1999 Qin et al.
6,017,417 A 1/2000 Wendt et al.
6,103,128 A 8/2000 Koso et al.
6,132,803 A 10/2000 Kelly et al.
6,238,518 B1 5/2001 Rokman et al.
6,511,579 B1 * 1/2003 Edwards et al. ..... 162/111

* cited by examiner

FOAM TREATMENT OF TISSUE PRODUCTS

RELATED APPLICATIONS

The present application claims priority to U.S. Provisional Application Ser. No. 60/246,771, filed on Nov. 8, 2000.

BACKGROUND OF THE INVENTION

Consumers use tissue products for a wide variety of applications. For example, various types of tissue products may be used, such as facial tissues, bath tissues, paper towels, napkins, wipes, etc. In many instances, various types of liquid-based compositions, such as softening compositions, lotions, friction reducing agents, adhesives, strength agents, etc., are also applied to one or tissue webs of the tissue product. For example, a tissue web is often softened through the application of a chemical additive (i.e., softener). However, one problem associated with some liquid-based compositions is the relative difficulty in uniformly applying the composition to the tissue web of the tissue product. Moreover, many application methods are relatively inefficient and thus may result in substantial waste of the composition being applied.

For instance, many softeners are made as an emulsion containing a particular solids content in solution. However, such liquid-based compositions are often difficult to adequately apply to a tissue web. In particular, when applying such a liquid-based composition, the tissue web can become undesirably saturated, thereby requiring the tissue web to be dried. Moreover, it is also difficult to uniformly spread the liquid-based composition on a tissue web in such a manner to provide adequate surface area coverage. In addition, some softeners contain components that cause the liquid-based composition to be formed as a solid or semi-solid. To facilitate application of these liquid-based compositions onto a tissue product, extensive heating may be required. Moreover, even after extensive heating, it may nevertheless be difficult to uniformly apply the composition to the tissue surface.

As such, a need currently exists for an improved method of applying a liquid-based composition to a tissue web.

SUMMARY OF THE INVENTION

In accordance with one embodiment of the present invention, a method is provided for applying a liquid-based composition to a web of a tissue product having a basis weight less than about 120 grams per square meter. The method comprises providing a papermaking furnish containing cellulosic fibers and forming a web from the papermaking furnish.

In addition, the method also includes applying a foam formed from a liquid-based composition to the web while the web has a solids consistency less than about 95% by weight of the web. In some embodiments, for example, the foam is applied to the web while the web has a solids consistency between about 60% to about 95% by weight of the web, and particularly, between about 80% to about 90% by weight of the web. In other embodiments, the foam is applied to the web while the web has a solids consistency between about 10% to about 35% by weight of the web, and particularly, between about 15% to about 30% by weight of the web.

The foam can generally be applied to the web in a variety of ways. For instance, in one embodiment, the foam can be drawn toward the web with a vacuum slot. Further, in some embodiments, the web can be supported on a first moving foraminous surface that defines a nip with a second moving foraminous surface such that the said foam is applied to the web at the nip.

Other features and aspects of the present invention are described in more detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
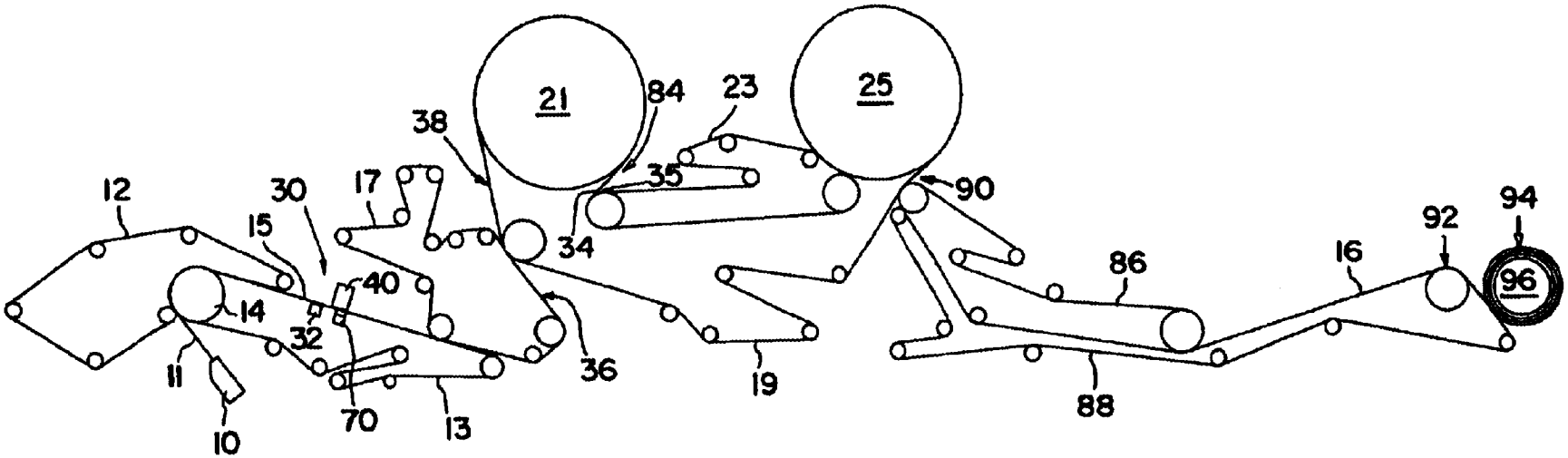
FIG. 1 is a schematic flow diagram of one embodiment of the present invention for forming a tissue web.

Repeat use of reference characters in the present specification and drawings is intended to represent same or analogous features or elements of the present invention.

DETAILED DESCRIPTION OF REPRESENTATIVE EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method for applying a liquid-based composition to a tissue web of a tissue product. In particular, the method of the present invention involves applying the liquid-based composition as a foam during the papermaking process to promote uniform application and to enhance efficiency. As used herein, the term "foam" generally refers to a porous matrix, which is an aggregate of hollow cells or bubbles, the walls of which contain liquid material. The cells may be interconnected to form channels or capillaries within the foam structure wherein such channels or capillaries facilitate liquid distribution within the foam.

By applying liquid-based compositions during the papermaking process, such as while the tissue web has a solids consistency less than about 95% by dry weight of the tissue web, the need for charge affinity between the particular liquid-based composition and the fibers of the tissue web is minimized. By reducing charge affinity, the number and type of liquid-based compositions that may be utilized may widely vary.

For instance, in one embodiment, a "liquid-based" composition may be foamed onto the tissue web. As used herein, a liquid-based composition generally refers to any composition that is capable of existing in a liquid state. In particular, a liquid-based composition may exist naturally in a liquid state, or may require liquid-enhancing aids, such as heating, foaming aids (e.g., surfactants), etc., to achieve such a liquid state. Moreover, a "liquid-based" composition also includes emulsions having a certain solids content. Some examples of liquid-based compositions that may be applied to a tissue web may include, but are not limited to, softening agents, wet-strength agents, binders, adhesives, friction-reducing agents, and the like.

Besides the components mentioned above, a variety of other materials may also be utilized in conjunction with a liquid-based composition that is foamed onto a tissue web in accordance with the present invention. In fact, any material may be added to the liquid-based composition as long as the material does not substantially affect the ability of the liquid-based composition to be formed into a foam. In particular, a liquid-based composition may often act as an effective carrier for various active ingredients desired to be applied to a tissue web.

For example, in one embodiment, a variety of foaming aids may be applied to the liquid-based composition. Foaming aids may be useful in facilitating the generation of foam. A foaming aid may also be useful in stabilizing existing foam. In general, any of a variety of foaming aids may be applied to the liquid-based composition. In particular, foaming aids that have a low critical miscelle concentration, are cationic and/or amphoteric, and have small bubble sizes are typically utilized. Some examples of suitable foaming aids include, but are not limited to, fatty acid amines, amides, and/or amine oxides; fatty acid quaternary compounds; electrolytes (to help achieve foam stability); and the like. Some commercially available foaming aids that are suitable in the present invention are Mackernium 516, Mackam 2C, and Mackam CBS-50G made by McIntyre Group, Ltd. When utilized, the foaming aids are generally incorporated into the liquid-based composition in amounts up to about 20% by weight of the liquid-based composition, and in some embodiments, between about 2% by weight to about 15% by weight. Other suitable foaming aids are described in U.S. Pat. No. 4,581,254 issued to Cunningham, et al., which is incorporated herein in its entirety by reference thereto for all purposes (hereinafter referred to as the "Cunningham et al. reference").

Still other examples of suitable materials that may be added to a liquid-based composition for application to a tissue web are disclosed in U.S. Pat. No. 5,869,075 issued to Krzysik, which is incorporated herein in its entirety by reference for all purposes. For instance, some of such materials include, but are not limited to: anti-microbial agents; odor absorbers; masking fragrances; anti-septic actives; anti-oxidants; astringents—cosmetic (induce a tightening or tingling sensation on skin); astringent—drug (a drug product which checks oozing, discharge, or bleeding when applied to skin or mucous membrane and works by coagulating protein); biological additives (enhance the performance or consumer appeal of the product); colorants (impart color to the product); emollients (help to maintain the soft, smooth, and pliable appearance of the skin by their ability to remain on the skin surface or in the stratum corneum to act as lubricants, to reduce flaking, and to improve the skin's appearance); external analgesics (a topically applied drug that has a topical analgesic, anesthetic, or antipruritic effect by depressing cutaneous sensory receptors, of that has a topical counterirritant effect by stimulating cutaneous sensory receptors); film formers (to hold active ingredients on the skin by producing a continuous film on skin upon drying); humectants (increase the water content of the top layers of the skin); natural moisturizing agents (NMF) and other skin moisturizing ingredients known in the art; opacifiers (reduce the clarity or transparent appearance of the product); skin conditioning agents; skin exfoliating agents (ingredients that increase the rate of skin cell turnover such as alpha hydroxy acids and beta hydroxyacids); skin protectants (a drug product which protects injured or exposed skin or mucous membrane surface from harmful or annoying stimuli); and the like.

In addition, the liquid-based composition may be formed into a foam according to any foam-forming technique known in the art. For instance, in one embodiment, a liquid-based composition may be metered to a foaming system where it may be combined with a gas, such as compressed air, in various proportions. For example, to ensure that the resulting foam is generally stable, the ratio of air volume to liquid volume in the foam (i.e., blow ratio) may be greater than about 3:1, and in some embodiments between about 5:1 to about 180:1. In some embodiments, a blow ratio between about 150:1 to about 180:1 is utilized, while in other embodiments, a blow ratio between about 15:1 to about 25:1 is utilized. For instance, in one embodiment, a blow ratio of about 30:1 may be obtained from a liquid flow rate of 113 grams per minute and an air flow rate of 3400 cubic centimeters per minute. In another embodiment, a blow ratio of about 20:1 may be obtained from a liquid flow rate of 240 grams per minute and an air flow rate of 4800 cubic centimeters per minute.

Within the foaming system, a foam generator may combine the air and the liquid-based composition at a certain energy so that a foam may form. In one embodiment, for example, the foam generator rotates at a certain speed so as to cause the liquid-based composition to pass through a series of edges, which allow trailing eddy currents of air to entrain into the liquid-based composition. In particular, the foam generator may operate at speeds from about 300 revolutions per minute (rpm) to about 700 rpm, and more particularly from about 400 rpm to about 600 rpm. For example, suitable foam generators are described in U.S. Pat. No. 4,237,818 issued to Clifford et al., which is incorporated herein in its entirety by reference thereto for all purposes (hereinafter referred to at the "Clifford et al. reference"). Moreover, one commercially available foam generator that may be utilized in the present invention may be obtained from Gaston Systems, located in Stanley, North Carolina.

The characteristics of the resulting foam may vary, depending on the parameters of the foam generator utilized, the ratio of the volume of gas to the volume of the liquid-based composition, etc. For instance, in some embodiments, the foam may have a "half-life" that allows the foam to travel from the foam generator to an applicator before degenerating. In some embodiments, a foam bubble may have a half-life of greater than about 3 minutes, more specifically, from about 3 minutes to about 30 minutes, and most specifically, from about 15 minutes to about 25 minutes.

The half-life of the foam may generally be determined in the following manner. A calibrated beaker is positioned on a scale and placed under a 500 cubic centimeter separator funnel. Approximately 50 grams of a foam sample is then collected into the separator funnel. As soon as all of the foam is placed in the funnel, a standard stopwatch is started. When approximately 25 grams of liquid collects into the calibrated beaker, the time is stopped and recorded. This recorded time is the foam half-life.

In some instances, the average cell size, wall thickness, and/or density may also foster the stability of the foam. For instance, the foam may have a size, thickness, or density such as described in U.S. Pat. No. 4,099,913 issued to Walter, et al. and U.S. Pat. No. 5,985,434 issued to Qin, et al., which are both incorporated herein in their entirety by reference thereto for all purposes. For example, in one embodiment, the average cell size of the foam cell may be between about 10 microns to about 100 microns. Moreover, the average wall thickness of the foam cell may be between about 0.1 micron to about 30 microns.

After generation, the foam is then forced out of the foam generator, where it may travel via one or more conduits to a foam applicator to be applied to a tissue web. The diameter of the conduits, the length of the conduits, the pressure of the foam bubbles after exiting the foam generator, and the like, may all be controlled to vary the nature of foam application. For instance, in one embodiment, a conduit having an inner diameter between about 0.375 inches to about 1.5 inches may be utilized to process about 300 to about 3000 cubic centimeters of air per minute and about 20 to about 300 grams of liquid per minute. Moreover, in one embodiment, the length of the conduit may be about 50 feet in length. In addition, upon exiting the foam generator, the pressure of the foam bubbles may be from about 5 psi to about 90 psi, and more particularly from about 30 psi to about 60 psi.

As stated, once the foam exits the foam generator, it may then be supplied to a foam applicator. In general, any foam applicator that is capable of applying a foam, such as described above, onto a tissue web having a solids consistency that is equal to or less than about 95% by dry weight of the tissue web may be used in the present invention. Although not required, in some embodiments, due to the relative wetness of the tissue web being applied with foam, it is also desired that the foam applicator be capable of applying foam without substantially contacting the surface of the tissue web during foam application. For instance, in some instances, the foam applicator may be positioned less than about 2 inches from the upper surface of the tissue web, and in some instances, less than about 1 inch from the upper surface of the tissue web. The foam applicator may be positioned about ½ inch from the upper surface of the tissue web, more specifically about ¼ inch from the upper surface of the tissue web, and most specifically about ⅛ inch from the upper surface of the tissue web.

As used herein, the term "lower surface" of the tissue web is understood to mean the fabric side of the tissue web, that is the side of the tissue web that is in contact with the forming fabric during the formation of the tissue web. As used herein, the term "upper surface" of the tissue web is understood to mean the air side of the tissue web, that is the side of the tissue web that was not in contact with the forming fabric during the formation of the tissue web.

Figure 2:
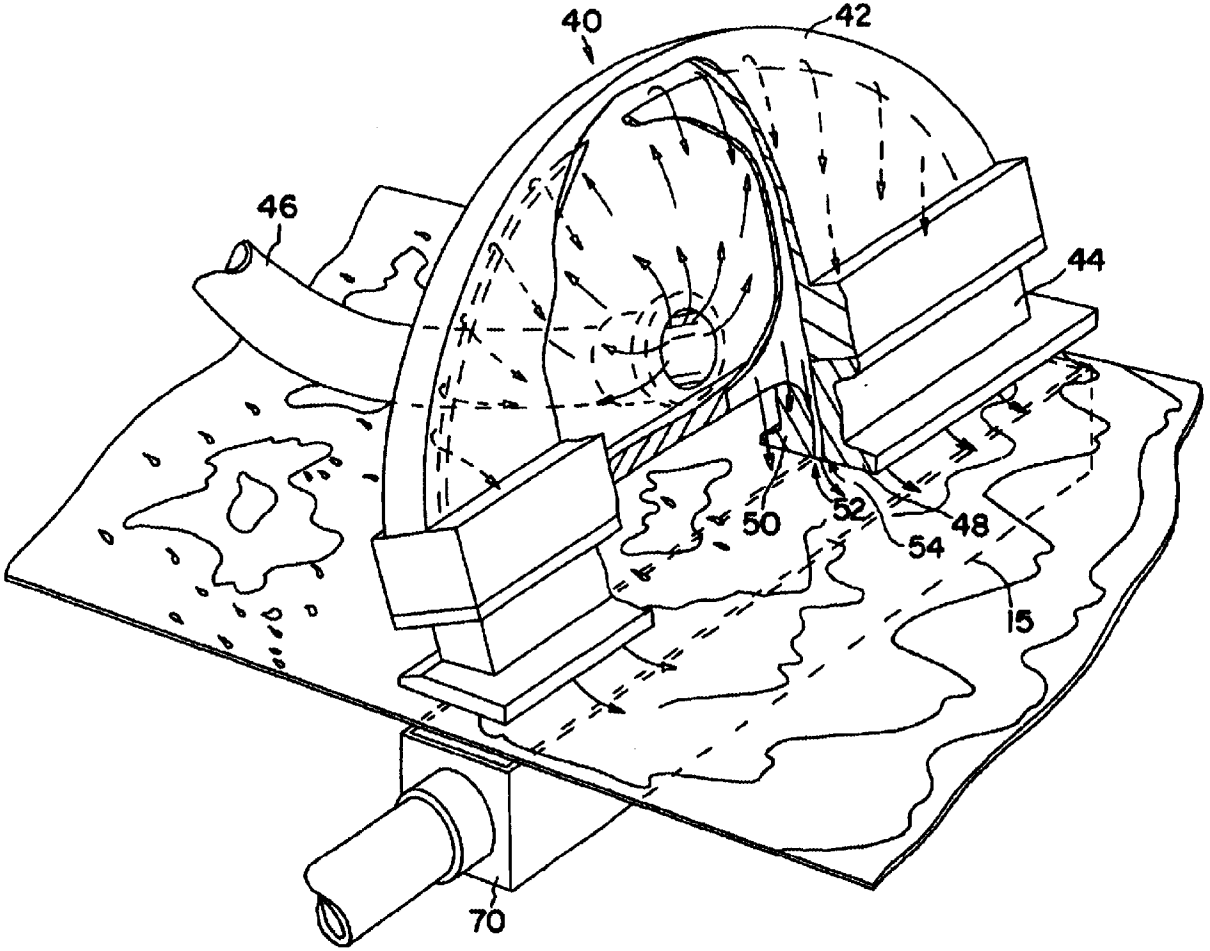
FIG. 2 is a perspective view of a foam applicator that may be used to apply foam to a tissue web in accordance with one embodiment of the present invention.

One particular example of a foam applicator 40 that may be used in the present invention is shown in FIG. 2. As depicted, the foam applicator 40 includes a distribution chamber 42 and an extrusion head 44. The distribution chamber 42 may generally have any desired shape, size, and/or dimension. For instance, the distribution chamber 42 shown in FIG. 2 has a parabolic shape. Other examples of suitable distribution chambers are described in the Clifford et al. reference. Moreover, it should also be understood that any method or apparatus for applying a foam to a tissue web may be used in the present invention, and that the foam applicator 40 depicted and described herein is for illustrative purposes only.

As the foam enters the distribution chamber 42 from a conduit 46, it is initially forced upward to assure that any decaying foam collects therein for automatic draining. Thereafter, it is forced downward, as indicated by the arrows in FIG. 2, through the distribution chamber 42 to the extrusion head 44. In general, extrusion heads having any of a variety of shapes and sizes may be used in the present invention. In the preferred embodiment of the present invention, a "straight slot" extrusion head, such as described in the Clifford, et al. reference and the Cunningham, et al. reference, is utilized. As used herein, the straight slot extrusion head generally refers to an extrusion head generally 44 having parallel nozzle bars 48 and 50. In one embodiment, the straight slot extrusion head 44 includes two parallel nozzle bars, a first nozzle bar 48 and a second nozzle bar 50, that form an extrusion slot 52 which is generally between about 0.025 inches to about 0.5625 inches in width, and in some embodiments, between about 0.050 inches to about 0.0626 inches in width. For instance, in one embodiment, the width of the extrusion slot 52 is about 0.13 inches. In another embodiment, the width of the extrusion slot 52 is about 0.05 inches.

Moreover, the length of the first and second nozzle bars 48 and 50 are typically such that the extrusion slot 52 has a length from about 0.125 inches to about 6 inches in the cross direction. The length of the extrusion slot 52, however, may be varied as desired to adjust the tissue web handling land area. For example, in one embodiment, the length of the extrusion slot 52 may be about 0.187 inches.

Figure 3:
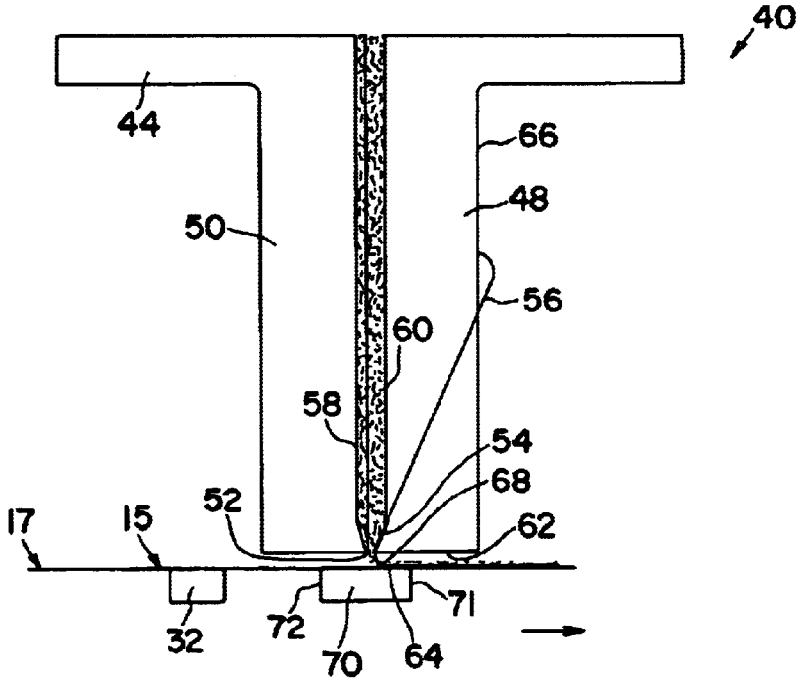
FIG. 3 is a cross-section of a foam applicator that may be used to apply foam to a tissue web in accordance with one embodiment of the present invention.
Figure 3A:
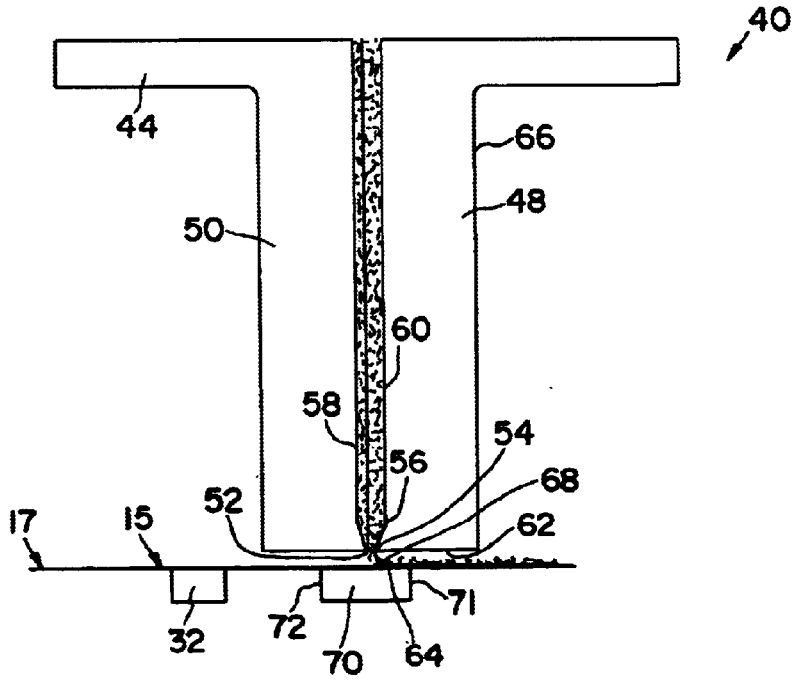
FIG. 3*a* is a cross-section of a foam applicator that may be used to apply foam to a tissue web in accordance with another embodiment of the present invention.
Figure 3B:
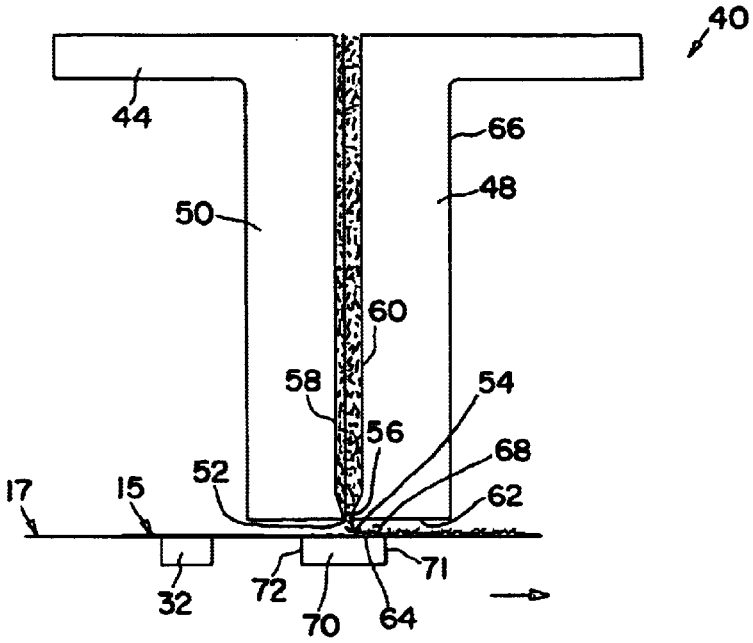
FIG. 3*b* is a cross-section of a foam applicator that may be used to apply foam to a tissue web in accordance with another embodiment of the present invention.

The first nozzle bar 48 of the extrusion head 44 includes a flexible scraper 54 having a lower surface 69 adjacent the wet tissue web 15 and an opposing upper surface 68. The first end 56 of the flexible scraper 54 may be attached to the outer surface 66 of the extrusion head 44, to the inner surface 60 of the first nozzle bar 48, or to the outer surface 62 of the first nozzle bar 48. (See FIGS. 3, 3*a*, and 3*b*.) The second end 64 of the flexible scraper 54 extends beyond the first nozzle bar 48. It is understood that the flexible scraper 54 may be attached to the extrusion head 44 in any configuration to achieve the positioning of the second end 64 as shown in FIGS. 3, 3*a*, and 3*b*. It is understood that the discussion relating to the treatment of the wet tissue web 15 is equally applicable to the treatment of the dried tissue web 16.

The length of flexible scraper 54 extends beyond the first nozzle bar 48 by at least the distance equal to the distance between the extrusion head 44 and the wet tissue web 15. Generally, the length of the flexible scraper 54 extending beyond the first nozzle bar 48 by a distance that is between about 1/16 inch to about 1 inch longer than the distance between the extrusion head 44 and the upper surface of the wet tissue web 15, and in some embodiments, between about ⅛ inch to 1 inch in length longer than the distance between the extrusion head 44 and the upper surface of the wet tissue web 15. According to other embodiments of the present invention, the length of the flexible scraper 54 extending beyond the first nozzle bar 48 by a distance between about ⅛ inch to about ½ inch longer than the distance between the extrusion head 44 and the upper surface of the wet tissue web 15, and more specifically between about ¼ inch to about ½ inch longer than the distance between the extrusion head 44 and the upper surface of the wet tissue web 15.

For instance, in one embodiment, the length of the flexible scraper 54 extending beyond the extrusion head 44 is about ½ inch longer than the distance between the extrusion head 44 and the upper surface of the wet tissue web 15. In another embodiment, the length of the flexible scraper 54 extending beyond the extrusion head 44 is about ¼ inch longer than the distance between the extrusion head 44 and the upper surface of the wet tissue web 15. The distance between the extrusion head 44 and the moving wet tissue web 15 and the length of the flexible scraper 54 that extends beyond the first nozzle bar 48 may be adjusted to ensure an optimum benefit of the flexible scraper 54.

The flexible scraper 54 may be made out of any of the following materials: mylar; plastic; rubber; metal; resin; teflon; and, any other material known in the art which is flexible, durable, and liquid impermeable. In various embodiments, the flexible scraper 54 has a thickness of between about 0.003 inch to about 0.015 inch, and in some embodiments, between about 0.005 inch to about 0.015 inch. According to another embodiment of the present invention, the flexible scraper 54 has a thickness of between about 0.005 inch to about 0.010 inch. For instance, in one embodiment, the thickness of the flexible scraper 54 is about 0.003 inch. In another embodiment, the thickness of the flexible scraper 54 is about 0.005 inch.

In accordance with this configuration, the second end 64 of the flexible scraper 54 is in contact with and, in some cases, deforms into a bent configuration by the higher points of the surface of the moving wet tissue web 15. The foam flows down the lower surface 69 of the flexible scraper 54 where the foam is deposited onto the wet tissue web 15 (or in some cases, the dried tissue web 16). The second end 64 causes the foam, thus the composition, to be more uniformly distributed over the surface of the wet tissue web 15 from the extrusion head 44. The foam may be distributed into the lower points as well as the higher points of the surface of the moving wet tissue web 15. The foam, using the teachings of the present invention, may be formulated and distributed so as to deposit the foam on the higher points of the moving wet web 15. In other embodiments of the present invention, the foam may be distributed in the lower points of the moving wet web 15.

In situations where the chemical add-on of the liquid-based composition is not excessive, typically less than about 10% of the basis weight of the dried tissue web 16, the application of the foam using standard foam applicators may have a tendency to contact, thereby coating, only a portion of the higher points, including such areas as the ridges or protuberances, in the surface of the wet tissue web 15. This can result in little or no chemical treatment of the composition reaching the low points, including such areas as the valleys or recesses, in the surface of the wet tissue web 15. In many instances, a uniform application of the foam to the higher points of the wet tissue web 15 is not achieved using standard foam applicators.

In some embodiments of the present invention, preferential treatment of the wet tissue web 15 may be accomplished using the extrusion head 44, providing a dried tissue web 16 having the desired improved properties using a reduced amount of the liquid-based composition. The flexible scraper 54 may be adjusted so that the foam contacts only the high points of the surface of the wet tissue web 15, providing a dried tissue web 16 having the desired improved properties while providing a more efficient use of composition. Such an application of the foam could be particularly advantageous in tissue products having multiple level surfaces such as rippled or embossed surfaces.

In accordance with the present invention, as shown in FIG. 3, the foam applicator 40, such as described above, may be positioned at a variety of locations within a papermaking process to apply foam to a wet tissue web 15. However, although the location of the foam applicator 40 is not critical, it is typically desired that the foam applicator 40 be positioned such that foam is applied when the wet tissue web 15 has a solids consistency less than about 95% by dry weight of the wet tissue web 15, and in some embodiments, less than about 90% by dry weight of the wet tissue web 15.

In embodiments where the wet tissue web 15 is not supported by a fabric, it may be desirable to provide an optional fabric that is more rigid than the wet tissue web 15 to carry the wet tissue web 15 at the time of the foam application. The optional fabric may ensure a more constant distance between the extrusion head 44 and the wet tissue web 15, thereby providing a more consistent application of the foam. An optional web handling vacuum slot 32 may be utilized to more firmly hold the wet tissue web 15 on a fabric during the application of the foam to the wet tissue web 15.

The optional web handling vacuum slot 32 may be positioned to extend across the full width of the wet tissue web 15. In other embodiment so the present invention, the web handling vacuum slot 32 may be positioned along one or both edges of the wet tissue web 15. The length of the web handling vacuum slot 32 positioned along each edge of the wet tissue web 15 is between about 3 inches and about 24 inches, more specifically of a length of between about 6 inches and about 18 inches, and most specifically of a length of between about 9 inches and about 18 inches. For instance, in one embodiment, the length of the web handling vacuum slot 32 positioned along at least one edge of the wet tissue web 15 is about 18 inches. In another embodiment, the length of the web handling vacuum slot 32 positioned along at least one edge of the wet tissue web 15 is about 12 inches.

The web handling vacuum slot 32 may generally be formed by a variety of devices that are capable of applying a negative pressure on the wet tissue web 15, such as vacuum boxes, vacuum shoes, vacuum rolls, foils, or any other method known in the art. Moreover, the vacuum slot 32 may have any desired size, dimension, and/or shape desired. For example, in some embodiments, the web handling vacuum slot 32 may have a slot opening width between about 1 inch and about ⅛ inch, more specifically a width between about ¾ inch and about ¼ inch, and most specifically a width between about ¾ inch and about ½ inch. For instance, in one embodiment, the web handling vacuum slot 32 has a slot opening width of about ½ inch. In another embodiment, the web handling vacuum slot 32 has a slot opening width of about ¾ inch.

The web handling vacuum slot 32 may be utilized to reduce the "boundary air layer" surrounding the wet tissue web 15. As used herein, a "boundary air layer" generally refers to a layer of air that is entrained by a moving fabric or tissue web supported on a fabric. Boundary air layers may be present at any speed at which a tissue machine is operated, including speeds of about 1,000 feet per minute, about 2,000 feet per minute, and 3,000 feet per minute or greater. For example, boundary air layers often occur at high linear speeds, such as at speeds above about 4,000 feet per minute, and in some embodiments, between about 4,000 feet per minute to about 6,000 feet per minute. Boundary air layers may sometimes disrupt foam application. As such, it is typically desired to minimize the boundary air layer to enhance the efficiency of foam application. In one embodiment, for example, the web handling vacuum slot 32 may be upstream from the foam applicator 40 to help minimize the boundary air layer. Further, various other mechanisms may also be utilized to minimize the boundary air layer, such as using deflecting mechanisms. Moreover, it should be understood that it may not be necessary to reduce the boundary air layer in all circumstances when applying a foam to a wet tissue web 15 in accordance with the present invention.

A vacuum slot 70 may be positioned to extend across the full width of the wet tissue web 15 in the cross direction of the wet tissue web 15 below the foam applicator 40. It is understood that the vacuum slot 70 may be one continuous vacuum slot or made up of multiple vacuum slots positioned across the CD direction of the wet tissue web 15. It is also understood that the length of the vacuum slot 70 in the CD direction may be of any value less than the CD width of the wet tissue web 15. The vacuum slot 70, as discussed above regarding the web handling vacuum slot 32, may generally be formed by a variety of devices that are capable of applying a negative pressure on the wet tissue web 15, such as vacuum boxes, vacuum shoes, vacuum rolls, foils, or any other method known in the art. The vacuum slot 70 may have a slot opening width between about 1 inch and about ⅛ inch, more specifically a width between about ¾ inch and about ¼ inch, and most specifically a width between about ¾ inch and about ½ inch. For instance, in one embodiment, the vacuum slot 70 has a slot opening width of about ½ inch. In another embodiment, the vacuum slot 70 has a slot opening width of about % inch.

Although not required, the vacuum slot 70 may aid in drawing the foam toward or into the wet tissue web 15. For instance, once formed, the foam bubbles generally remain under pressure until the instant of application to the wet tissue web 15 by the foam applicator 40 so that the liquid forming the bubbles may be blown onto the wet tissue web 15 by airlet(s) and/or nozzle(s) of the foam applicator 40. As shown in FIG. 3, a vacuum slot 70 may draw these foam bubbles towards the wet tissue web 15, thereby facilitating the application of the foam onto or into the wet tissue web 15. It should be understood that other vacuum slot(s) located in various positions may be utilized in the present invention. Moreover, it should also be understood that a vacuum slot is not required to apply foam to the wet tissue web 15.

The vacuum slot 70 may also be utilized to reduce the boundary air layer surrounding the wet tissue web 15. In addition, the vacuum slot 70 assists with the deposition of the foam onto the wet tissue web 15. The vacuum slot 70 also aids in the removal of the air that is entrained within the foam.

In some embodiments of the present invention, the vacuum slot 70 may be positioned such that the front edge 71 of the vacuum slot 70 extends beyond the second end 64 of the flexible scraper 54 in the machine direction where the second end 64 is positioned on the wet tissue web 15. When placed in such a position, the vacuum slot 70 is able to also provide a cleaning function to the upper surface 68 of the flexible scraper 54. During use of the flexible scraper 54, dust and other matter may collect on the upper surface 68 of the flexible scraper 54, thereby interfering with the operation of the flexible scraper 54 and the application of the foam to the wet tissue web 15. The vacuum slot 70 with at least the front edge 71 positioned beyond the second end 64 of the flexible scraper 54 in the machine direction draws air from above the upper surface 68 of the flexible scraper 54 down over the upper surface 68 and through the wet tissue web 15, thereby removing the matter that may have settled on the upper surface 68. The front edge 71 of the vacuum slot 70 extends beyond the second end 64 of the flexible scraper 54 in the machine direction by a distance of between about 1 inch to about ⅛ inch, more specifically a distance of between about ¾ inch to about ¼ inch, and most specifically a distance of between about ¾ inch to about ½ inch. For instance, in one embodiment, the front edge 71 of the vacuum slot 70 extends beyond the second end 64 of the flexible scraper 54 in the machine direction by a distance of about ¾ inch. In another embodiment, the front edge 71 of the vacuum slot 70 extends beyond the second end 64 of the flexible scraper 54 in the machine direction by a distance of about ½ inch.

In some instances, the back edge 72 of the vacuum slot 70 is positioned within about 1 inch in front of to about 1 inch beyond (in the machine direction) the second end 64 of the flexible scraper 54. The range of the distance of the back edge 72 of the vacuum slot 70 may be from about ¾ inch to about 0 inch in front of or beyond the second end 64 of the flexible scraper 54, more specifically a distance of between about ¾ inch to about ⅛ inch, and most specifically a distance of between about ¾ inch to about ¼ inch. For instance, in one embodiment, the back edge 72 of the vacuum slot 70 may be adjusted to a distance of about ¾ inch in front of or beyond the second end 64 of the flexible scraper 54. In another embodiment, the back edge 72 of the vacuum slot 70 may be adjusted to a distance of about ½ inch in front of or beyond the second end 64 of the flexible scraper 54.

In general, any type of tissue construction can be applied with a foam composition in accordance with the present invention. For example, the tissue product can be a single or multi-ply tissue. Normally, the basis weight of a tissue product of the present invention is less than about 120 grams per square meter, particularly from about 5 grams per square meter to about 60 grams per square meter, particularly from about 10 grams per square meter to about 55 grams per square meter, and more particularly between about 10 grams per square meter to about 35 grams per square meter. In addition, one or more surfaces of the tissue can be provided with elevated regions (e.g., protrusions, impressions, or domes), such as described in more detail below.

A tissue web that can be used in the present invention can generally be formed by any of a variety of papermaking processes known in the art. In particular, it should be understood that the present invention is not limited to any particular papermaking process. In fact, any process capable of forming a paper or tissue web can be utilized in the present invention. For example, a papermaking process of the present invention can utilize creping, embossing, wet-pressing, through-drying, through-dry creping, uncreped through-drying, double creping, calendering, as well as other steps in forming the tissue product.

In this regard, one embodiment of a papermaking process, including some optional locations for one or more foam applicators 40, is illustrated in FIG. 1 as 30, 36, 38, 84, 90, 92, and 94. It is understood that other locations may be used for foam application in accordance with the present invention as well. For simplicity, the various tensioning rolls schematically used to define the several fabric runs are shown but not numbered. In particular, the papermaking process depicted in FIG. 1 utilizes an uncreped through-drying technique to form the tissue web. Examples of such a technique are disclosed in U.S. Pat. No. 5,048,589 issued to Cook, et al.; U.S. Pat. No. 5,399,412 issued to Sudall, et al.; U.S. Pat. No. 5,510,001 issued to Hermans, et al.; U.S. Pat. No. 5,591,309 issued to Rugowski, et al.; and, U.S. Pat. No. 6,017,417 issued to Wendt, et al., which are incorporated herein in their entirety by reference thereto for all purposes. The U.S. Pat. No. 6,017,417 is hereinafter referred to at the "Wendt et al. reference".

Uncreped through-drying generally involves the steps of: (1) forming a furnish of cellulosic fibers, water, and optionally, other additives; (2) depositing the furnish on a moving foraminous surface (e.g., belt, fabric, wire, etc.), thereby forming a tissue web on top of the moving foraminous surface; (3) subjecting the tissue web to through-drying to remove the water from the tissue web; and, (4) removing the dried tissue web from the moving foraminous surface. However, it should be understood that other variations of the embodiments described herein and other methods for forming a tissue web are equally suitable for use in the present invention. Moreover, it should also be understood that any other process known in the art for forming a tissue web may also be utilized in the present invention. For example, the papermaking process may utilize creping, embossing, wet-pressing, through-drying, through-dry creping, uncreped through-drying, double creping, calendering, as well as other known steps and/or papermaking devices (e.g., Yankee dryers) in forming the tissue web.

In this regard, referring again to FIG. 1, a papermaking headbox 10 may be used to inject or deposit a stream 11 of an aqueous suspension onto the forming fabric 12. The aqueous suspension supplied by the headbox 10 may generally be formed from a variety of materials. In particular, a variety of natural and/or synthetic fibers may be used. For example, some suitable natural fibers may include, but are not limited to, nonwoody fibers, such as abaca, sabai grass, milkweed floss fibers, pineapple leaf fibers; softwood fibers, such as northern and southern softwood kraft fibers; and, hardwood fibers, such as eucalyptus, maple, birch, aspen, and the like. Illustrative examples of other suitable pulps include southern pines, red cedar, hemlock, and black spruce. Exemplary commercially available long pulp fibers suitable for the present invention include those available from Kimberly-Clark Corporation under the trade designations "Longlac-19". In addition, furnishes including recycled fibers may also be utilized. Moreover, some suitable synthetic fibers may include, but are not limited to, hydrophilic synthetic fibers, such as rayon fibers and ethylene vinyl alcohol copolymer fibers, as well as hydrophobic synthetic fibers, such as polyolefin fibers.

The headbox 10 may be any papermaking headbox used in the art, such as a stratified headbox capable of producing a multilayered tissue web. For example, it may be desirable to provide relatively short or straight fibers in one layer of the tissue web to give a layer with high capillary pressure, while another layer contains relatively longer, bulkier, or more curled fibers for high permeability and high absorbent capacity and high pore volume. It may also be desirable to apply different chemical agents to separate layers of the tissue web to optimize dry and wet strength, pore space, wetting angle, appearance, or other properties of a tissue web. Further, multiple headboxes may be used to create a layered structure, as is known in the art.

As shown, with the aid of a roll 14, the stream 11 is then transferred from the forming fabric 12 to a drainage fabric 13, which serves to support and carry the newly-formed wet tissue web 15 downstream in the process as the wet tissue web 15 is partially dewatered to a solids consistency of about 10% by dry weight of the wet tissue web 15. In some instances, additional dewatering of the wet tissue web 15 may be carried out, such as by a vacuum slot 70, while the wet tissue web 15 is supported by the drainage fabric 13.

In accordance with the present invention, a foam applicator 40 may be optionally positioned at a location 30 to supply foam to the wet tissue web 15 as it is carried on the drainage fabric 13. For example, in some embodiments, the foam applicator 40 may be positioned less than about 2 inches from the upper surface of the wet tissue web 15, and in some embodiments, less than about 1 inch from the wet tissue web 15. In this embodiment, the consistency of the wet tissue web 15 being applied with foam is typically between about 10% to about 35%, and in some embodiments, between about 15% to about 30%. Due to the relatively high moisture content of the wet tissue web 15, the foam applicator 40 may be configured to apply the foam in a manner such that it tends to migrate through the entire wet tissue web 15. However, it should also be understood that the foam applicator 40 may also be configured to apply the foam primarily onto the surface of the wet tissue web 15.

In some embodiments, a vacuum slot 70, such as described above, may also be utilized in conjunction with the foam applicator 40 to aid in applying foam to the wet tissue web 15. Although not required, the vacuum slot 70 may aid in drawing the foam towards or into the wet tissue web 15.

Referring again to FIG. 1, the wet tissue web 15 is then transferred from the drainage fabric 13 to a transfer fabric 17 that may travel at a slower speed than the drainage fabric 13 in order to impart increased stretch into the wet tissue web 15. This is commonly referred to as "rush" transfer. One useful method of performing rush transfer is taught in U.S. Pat. No. 5,667,636 issued to Engel et al., which is incorporated herein in its entirety by reference thereto for all purposes. The relative speed difference between the drainage fabric 13 and the transfer fabric 17 may be from 0% to about 80%, in some embodiments from about 10% to about 60%, and in some embodiments, from about 10% to about 40%. The transfer may be carried out with the assistance of a vacuum shoe or roll such that the drainage fabric 13 and the transfer fabric 17 simultaneously converge and diverge at the leading edge of the vacuum slot of the vacuum shoe or roll.

Thereafter, the wet tissue web 15 is transferred from the transfer fabric 17 to a through-drying fabric 19 with the aid of a vacuum transfer roll or shoe. The through-drying fabric 19 may be traveling at about the same speed or a different speed relative to the transfer fabric 17. For example, if desired, the through-drying fabric 19 may run at a slower speed to further enhance stretch. The vacuum transfer roll or shoe (negative pressure) may be supplemented or replaced by the use of positive pressure from the opposite side of the wet tissue web 15 to blow the wet tissue web 15 onto the next fabric.

In some embodiments, the through-drying fabric 19 may be a smoother fabric, such as Asten 934, 937, 939, 959 or Albany 94M. However, in other embodiments, it may be desired to form elevated regions and depressions into the wet tissue web 15. To impart such elevated regions, in one embodiment, the through-drying fabric 19 may be a fabric having impression knuckles, such as described in the Wendt et al. reference. For example, when imprinted with elevations, the resulting tissue web can have between about 5 to about 300 protrusions per square inch. Moreover, the protrusions can have a height relative to the plane of the basesheet, as measured in the uncalendered state and uncreped state, of greater than about 0.1 mm, particularly greater than about 0.2 mm, more particularly greater than about 0.3 mm, and in most embodiments, from about 0.25 mm to about 0.6 mm.

Thereafter, a through-dryer 21 may accomplish the removal of moisture from the wet tissue web 15 by passing air through the wet tissue web 15 without applying any mechanical pressure. The through-drying process may also increase the bulk and softness of the wet tissue web 15. In one embodiment, for example, the through-dryer 21 may contain a rotatable, perforated cylinder and a hood (not shown) for receiving hot air blown through perforations of the cylinder as through-drying fabric 19 carries the wet tissue web 15 over the upper portion of the cylinder. The heated air is forced through the perforations in the cylinder of the through-dryer 21 and removes the remaining water from the wet tissue web 15. The temperature of the air forced through the wet tissue web 15 by the through-dryer 21 may vary, but is typically from about 300° F. to about 400° F.

While supported by the through-drying fabric 19, the wet tissue web 15 may then be partially dried by the through-dryer 21, such as, for example, to a solids consistency of less than about 95% by dry weight of the wet tissue web 15, in some embodiments to a solids consistency of between about 60% to about 95% by dry weight of the wet tissue web 15, and in some embodiments, to a solids consistency of between about 80% to about 90% by dry weight of the wet tissue web 15.

In accordance with the present invention, a foam applicator 40 may optionally be positioned at or near the nip 35 formed by the through-drying fabric 19 and a fabric 23. For example, in some embodiments, the foam applicator 40 may be positioned less than about 2 inches from the nip 35, and in some embodiments, less than about 1 inch from the nip 35. In this embodiment, the solids consistency of the wet tissue web 15 being applied with foam is typically between about 60% to about 95% by dry weight of the wet tissue web 15, and in some embodiments, between about 80% to about 90%. Due to the relatively high moisture content of the wet tissue web 15, the foam applicator 40 may be configured to apply the foam in a manner such that it tends to migrate through the entire wet tissue web 15. However, it should also be understood that the foam applicator 40 may also be configured to apply the foam primarily onto the surface of the wet tissue web 15.

In some instances, applying foam at a nip formed between two or more moving foraminous surfaces, such as the nip 35 formed between the through-drying fabric 19 and the fabric 23, may facilitate the uniform application of foam to the wet tissue web 15. In particular, when two moving surfaces form a nip, such as the nip 35 shown in FIG. 1, the motion of the surfaces typically creates an area of suction just above the nip. Thus, by locating a foam applicator 40 near this area of suction, foam dispensed by the applicator 40 is naturally drawn to the nip 35 and onto the wet tissue web 15 passing therethrough. As such, in accordance with the present invention, foam applicators may optionally be located at or near any nip formed by two or more moving foraminous surfaces to facilitate foam application.

Moreover, to further aid in the application of foam to the wet tissue web 15, a vacuum slot 34, such as described above, may also be utilized. Besides being used to aid in foam application, vacuum slots may also be used to partially dewater the wet tissue web 15, to reduce the boundary air layer, etc.

After being dried by the through-dryer 21 and optionally applied with foam at the nip 35, the wet tissue web 15 is then sandwiched between the through-drying fabric 19 and the fabric 23 to further dewater the wet tissue web 15. In some instances, another through-dryer 25 may substantially dry the wet tissue web 15 by passing air therethrough without applying any mechanical pressure. For example, in some embodiments, the wet tissue web 15 may be dried to a consistency of about 95% or greater by the through-dryer 21, thereby forming a dried tissue web 16. The dried tissue web 16 may be carried on additional fabrics, such as transfer fabrics 86 and 88 as shown in FIG. 1.

Foam may additionally be applied to the dried tissue web 16 at the location 90, at location 92, or at the location 94. The dried tissue web 16 may then be transferred to a winding reel 96, or to various off-line processing stations, such as subsequent off-line calendering to improve the smoothness and softness of the dried tissue web 16. In some instances, the foam is additionally applied to a dry or over-dried tissue web 16 having a solids consistency equal to or greater than about 95%, more specifically equal to or greater than about 96%, more specifically equal to or greater than about 97%, more specifically equal to or greater than 98%, and more specifically equal to or greater than about 99%.

In some embodiments of the present invention, the speed of the wet tissue web 15 and the dried tissue web 16 may be established such that the composition so applied does not dry or set before the dried tissue web 16 is wound on a parent roll or any other roll. The composition may then be partially transferred to the untreated surface of the dried tissue web 16. A nip may be positioned to assist such a transfer.

Figure 4:
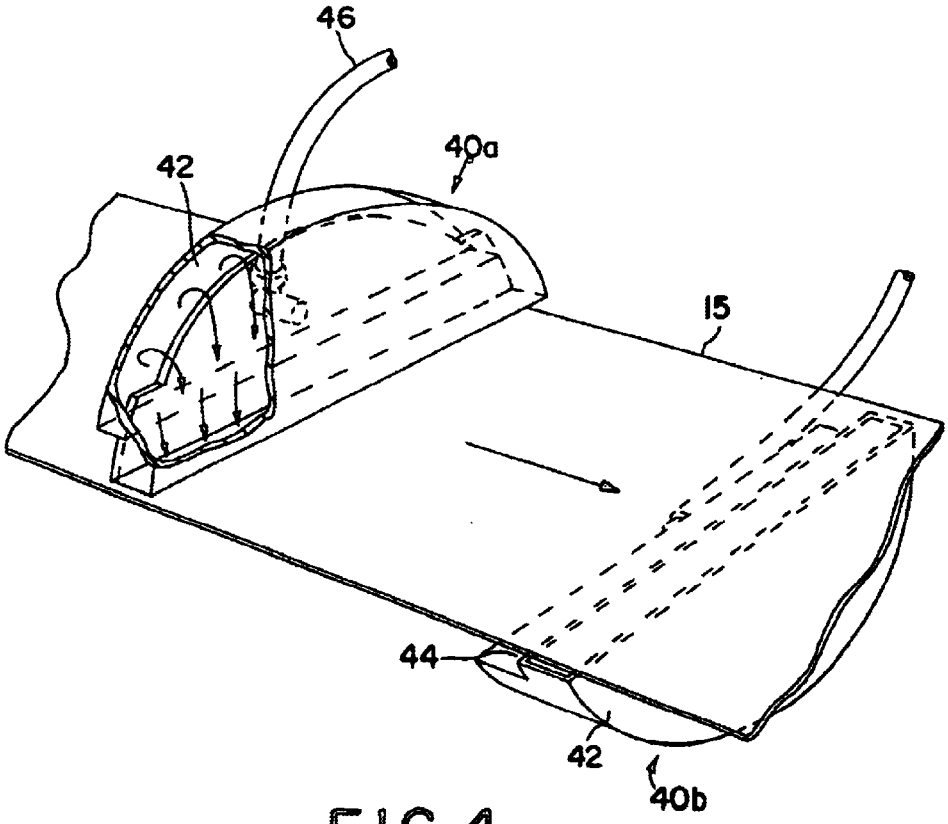
FIG. 4 is a perspective view of one embodiment of top and bottom foam applicators used to foam a composition onto a tissue in accordance with the present invention.

Although the use of only one foam applicator 40 is described in detail herein, it should be understood that any number of foam applicators 40 may be used. For instance, as shown in FIG. 4, a first foam applicator **40*a* is shown as depositing a foam composition onto the top surface of the wet tissue web 15, while a second applicator 40*b* is shown as depositing a foam composition on the bottom surface of the wet tissue web 15. The second foam applicator 40*b* may be the same or different than the first foam applicator 40*a*. Moreover, although not required, it is typically desired that the first and second foam applicators 40*a* and 40*b* be positioned in a staggered configuration so that the wet tissue web 15 can be better deflected around the first and second foam applicators 40*a* and 40*b*. It should also be understood that additional foam applicators 40 may be utilized in conjunction with the first and second applicators 40*a* and 40*b* to deposit foam compositions onto the top and/or bottom surfaces of the wet tissue web 15**.

In other embodiments of the foam applications of the present invention, both surfaces of the wet tissue web 15 may be treated with the composition using the apparatus as disclosed herein. Both surfaces of the wet tissue web 15 may be treated at substantially the same time or one surface of the wet tissue web 15 may be treated with the composition and then the other surface of the wet tissue web 15 subsequently treated with the composition. In other embodiments of the present invention, one surface of the wet tissue web 15 is treated with one composition and the other surface of the wet tissue web 15 is treated with another composition.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of incorporating a liquid-based composition into a tissue product having a basis weight less than about 120 grams per square meter, said method comprising:

forming a web on a moving foraminous surface from a papermaking furnish containing cellulosic fibers;

applying a foam formed from the liquid-based composition to said web while said web has a solids consistency less than about 95% by weight of the web; and drawing said foam towards said web with a vacuum slot.

2. A method as defined in claim 1, wherein said foam is applied to said web while said web has a solids consistency between about 60% to about 95% by weight of the web.

3. A method as defined in claim 2, wherein said foam is applied to said web while said web has a solids consistency between about 80% to about 90% by weight of the web.

4. A method as defined in claim 1, wherein said foam is applied to said web while said web has a solids consistency between about 10% to about 35% by weight of the web.

5. A method as defined in claim 4, wherein said foam is applied to said web while said web has a solids consistency between about 15% to about 30% by weight of the web.

6. A method as defined in claim 1, further comprising drawing air from a boundary of said web with a vacuum slot.

7. A method as defined in claim 1, wherein said web moving foraminous surface defines a nip with another moving foraminous surface, said foam being applied to said web at said nip.

8. A method as defined in claim 1, wherein the tissue product has a basis weight between about 5 to about 70 grams per square meter.

9. A method as defined in claim 1, further comprising drying said web.

10. A method as defined in claim 9, wherein said web is dried with at least one through-dryer.

11. A method of incorporating a liquid-based composition into a tissue product having a basis weight less than about 120 grams per square meter, said method comprising:

forming a web on a moving foraminous surface from a papermaking furnish containing cellulosic fibers, said web having a first surface and a second surface opposing said first surface;

positioning a foam applicator adjacent to said first surface of said web without substantially contacting said first surface of said web, said foam applicator being furnished with a foam formed from the liquid-based composition;

dispensing said foam from said foam applicator onto said web while said web has a solids consistency less than about 95% by weight of the web;

positioning a vacuum slot adjacent to said second surface of said web so that said foam is drawn towards said web when dispensed from said foam applicator; and drying said web.

12. A method as defined in claim 11, wherein said foam is dispensed onto said web while said web has a solids consistency between about 60% to about 95% by weight of the web.

13. A method as defined in claim 12, wherein said foam is dispensed onto said web while said web has a solids consistency between about 80% to about 90% by weight of the web.

14. A method as defined in claim 11, wherein said foam is dispensed onto said web while said web has a solids consistency between about 10% to about 35% by weight of the web.

15. A method as defined in claim 14, wherein said foam is dispensed onto said web while said web has a solids consistency between about 15% to about 30% by weight of the web.

16. A method as defined in claim 11, further comprising drawing air from a boundary of said web with a vacuum slot.

17. A method as defined in claim 11, wherein said moving foraminous surface defines a nip with another moving foraminous surface, said foam being dispensed onto said web at said nip.

18. A method as defined in claim 11, wherein the tissue product has a basis weight between about 5 to about 70 grams per square meter.

19. A method as defined in claim 11, wherein said web is dried with at least one through-dryer.

20. A method of incorporating a liquid-based composition into a tissue product having a basis weight less than about 120 grams per square meter, said method comprising:

forming a web from a papermaking furnish containing cellulosic fibers; and applying a foam formed from the liquid-based composition to said web while said web has a solids consistency between about 10% to about 35% by weight of the web.

21. A method of incorporating a liquid-based composition into a tissue product having a basis weight less than about 120 grams per square meter, said method comprising:

forming a web from a papermaking furnish containing cellulosic fibers, said web having a first surface and a second surface opposing said first surface;

positioning a foam applicator adjacent to said first surface of said web without substantially contacting said first surface of said web, said foam applicator being furnished with a foam formed from the liquid-based composition; and dispensing said foam from said foam applicator onto said web while said web has a solids consistency between about 10% to about 35% by weight of the web.

22. A method of incorporating a liquid-based composition into a tissue product having a basis weight less than about 120 grams per square meter, said method comprising:

depositing a furnish containing cellulosic fibers and water onto a moving foraminous surface, thereby forming a web on said foraminous surface, said web having a first surface and a second surface opposing said first surface;

positioning a foam applicator adjacent to said first surface of said web without substantially contacting said first surface of said web, said foam applicator being furnished with a foam formed from the liquid-based composition;

dispensing said foam from said foam applicator onto said web while said web has a solids consistency between about 10% to about 35% by weight of the web; and thereafter, drying said web to remove water therefrom.

* * * * *

UNITED STATES PATENT AND TRADEMARK OFFICE

CERTIFICATE OF CORRECTION

PATENT NO. : 6,852,196 B2
APPLICATION NO. : 10/007627
DATED : February 8, 2005
INVENTOR(S) : Joseph G. Capizzi It is certified that error appears in the above-identified patent and that said Letters Patent is hereby corrected as shown below:

On Title page item 57
Abstract: “Whenapplied” should be --“When applied”--

Signed and Sealed this

Thirteenth Day of February, 2007

JON W. DUDAS
*Director of the United States Patent and Trademark Office*